US009017032B2

(12) United States Patent
Mason

(10) Patent No.: US 9,017,032 B2
(45) Date of Patent: Apr. 28, 2015

(54) BLADED ROTOR

(75) Inventor: Paul Mason, Derby (GB)

(73) Assignee: Rolls-Royce plc, London (GB)

( * ) Notice: Subject to any disclaimer, the term of this patent is extended or adjusted under 35 U.S.C. 154(b) by 541 days.

(21) Appl. No.: 13/399,260

(22) Filed: Feb. 17, 2012

(65) Prior Publication Data

US 2012/0244007 A1 Sep. 27, 2012

(30) Foreign Application Priority Data

Mar. 22, 2011 (GB) ..... 1104794.1

(51) Int. Cl.
*F04D 29/32* (2006.01)
*F01D 11/00* (2006.01)

(52) U.S. Cl.
CPC ..... *F04D 29/322* (2013.01); *F01D 11/008* (2013.01)

(58) Field of Classification Search
CPC ..... F04D 29/322; F01D 11/008
USPC ..... 416/179, 189, 190, 193 R, 193 A, 194, 416/239, 500
See application file for complete search history.

(56) References Cited

U.S. PATENT DOCUMENTS 2,595,829 A 5/1952 Dean
3,451,654 A * 6/1969 Johnson ..... 416/190
4,177,013 A * 12/1979 Patterson et al. ..... 416/193 A
5,791,877 A 8/1998 Stenneler
2007/0280830 A1 12/2007 Mulcaire et al.
2011/0037233 A1 * 2/2011 Harper ..... 277/551

FOREIGN PATENT DOCUMENTS

EP 2 295 727 A2 3/2011
GB 2 418 709 A 4/2006
GB 2 427 900 A 1/2007

OTHER PUBLICATIONS

Jun. 29, 2011 Search Report issued in British Patent Application No. 1104794.1.

* cited by examiner

*Primary Examiner* — Edward Look
*Assistant Examiner* — Danielle M Christensen
(74) *Attorney, Agent, or Firm* — Oliff PLC

(57) ABSTRACT

A rotor, such as a fan of a gas turbine engine, comprises blades 2 and annulus fillers 4 which extend between adjacent blades 2. Gaps 22 between each blade 2 and the adjacent annulus fillers 4 are sealed by sealing elements 8. The sealing elements 8 fit closely around the profile of the blade 2 and have annulus filler sealing surfaces 18 for sealing contact with the annulus fillers 4. The sealing elements 8 have low-friction blade sealing surfaces 12 so that, when the fan is rotating, centrifugal loading displaces the sealing elements 8 radially outwardly so that the annulus filler sealing surface 18 make sealing contact with the annulus fillers 4.

21 Claims, 2 Drawing Sheets

BLADED ROTOR

This invention relates to a bladed rotor having an array of blades and an annulus filler which is disposed between adjacent blades. The invention is particularly, although not exclusively, concerned with a rotor in the form of a fan of a turbofan gas turbine engine.

The fan of such an engine typically comprises a rotor disc provided with a circumferential array of fan blades. It is common for annulus fillers to be provided between adjacent blades of the fan in order to provide an air washed surface which has the desired aerodynamic profile, and provides a transition between forward and aft components such as a spinner fairing and a fan rear seal.

A clearance is left between each blade and the annulus filler on each side of it, in order to accommodate relative movement between the blades and the annulus fillers during operation of the engine. It is known to provide a seal between each annulus filler and the adjacent fan blades in the form of resilient strips bonded to edges of the annulus fillers adjacent the fan blades. The strips contact the fan blades to seal the gaps, so preventing air leakage past the inner wall of the annular gas passage defined by the annulus fillers.

In a known sealing arrangement, for example as disclosed in US2007/0280830, seals of a suitable resilient material are bonded to the underside of the annulus filler, i.e. to the radially inner surface with respect to the rotational axis of the fan. The seal has a flap which extends radially inwardly from the annulus filler and towards the blade, and makes contact with the blade at its radially inner end to seal the gap. Such seals leave an unsealed channel between the blade and the annulus filler which extends below the annulus line to the point at which the flap meets the blade. This channel allows air to recirculate at the fan root, which has a detrimental effect on engine performance.

Alternative seal configurations, such as bellows seals, which aim to reduce or eliminate the size of the channels, have proved vulnerable to erosion at regions which project into, or lie close to, the airstream flowing over the annulus fillers.

Annulus filler seals require periodic replacement following erosion by the gas stream and wear at the regions of contact with the blades. In general, known seal configurations require the entire annulus filler structure to be dismantled and refurbished, since the bonded seals have to be removed from the annulus fillers. Furthermore, known bonded seals require high quality bonding to the annulus fillers, since the failure of the bond allows a seal to become fully or partly detached from the annulus filler. This compromises performance and requires remedial action.

According to the present invention there is provided a bladed rotor assembly for rotating about an axis and having a sealing element providing a seal between a blade of the rotor and an adjacent annulus filler, the sealing element having an opening receiving the blade, the opening being defined by a sleeve extending around the blade and providing a blade sealing surface which conforms to the profile of the blade, the sealing element also having an annulus filler sealing surface provided on a radially outer face of the sealing element, with respect to the rotational axis of the rotor for sealing engagement with the annulus filler.

The sealing element is wrapped around the blade, and consequently is carried by the blade. There is no requirement for bonding the seal to the annulus filler, so alleviating many of the problems with known seal configurations.

The sealing element maybe disposed radially inwards of the annulus filler.

The sealing element may be radially slidable on the blade, and for this purpose the blade sealing surface may be provided with a low friction finish.

An abutment element may be provided on an outer face of the sealing element, with respect to the opening, for engagement with an abutment surface of the annulus filler, in order to limit relative displacement of the annulus filler in the direction towards the blade. A series of such abutments may be provided around the sealing element. For example, two of the abutments may be provided on each of the pressure side and the suction side of the blade.

The sealing element may comprise a lateral flange which projects outwardly, away from the opening, at the radially outer end of the sleeve. The annulus filler sealing surface may be provided on the radially outer face of the flange.

Where one or more abutment elements are provided, the or each abutment element may comprise a radially inwardly directed lug at the periphery of the lateral flange.

The sealing element may be formed as a body of an elastomeric material which provides the blade sealing surface and the annulus filler sealing surface. A stiffening element may be bonded to or incorporated within the body. The body may comprise an internal compliant region adjacent the blade sealing surface in order to provide greater compliance to the blade sealing surface. The internal compliant region may comprise a cavity, which may be air-filled or may contain a material having greater compliance than that of the elastomeric material.

The sealing element and the blade may have cooperating features to restrict displacement of the sealing element along the blade, and in particular to restrict displacement in the direction away from the annulus filler.

The sealing element may be circumferentially split, for example at the leading or trailing edge of the blade, in order to enable the sealing element to be fitted over the blade. Closure means may be provided for preventing separation of the regions of the sealing element at the split, in order to retain the sealing element on the blade after fitting.

The present invention also provides a sealing element for installation in a bladed rotor as defined above.

For a better understanding of the present invention, and to show more clearly how it may be carried into effect, reference will now be made, by way of example, to the accompanying drawings, in which:

FIG. 1 shows a fan blade provided with an annulus filler seal, viewed from the leading edge of the blade and showing principally the suction side of the blade;

FIG. 2 corresponds to FIG. 1 but shows the suction side of the blade;

Figure 3:
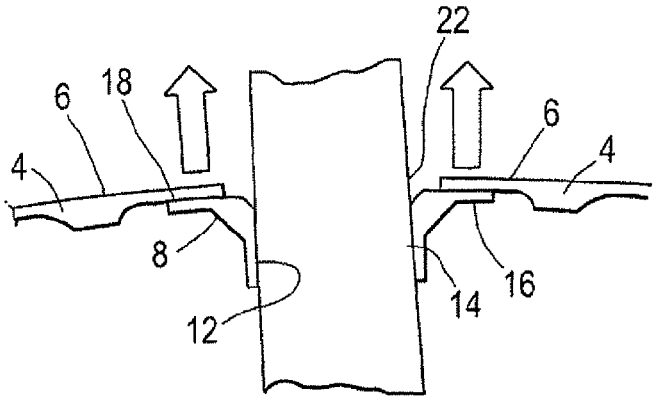
FIG. 3 is a sectional view of an assembly comprising the blade and the annulus filler seal assembled with annulus fillers.
Figure 4:
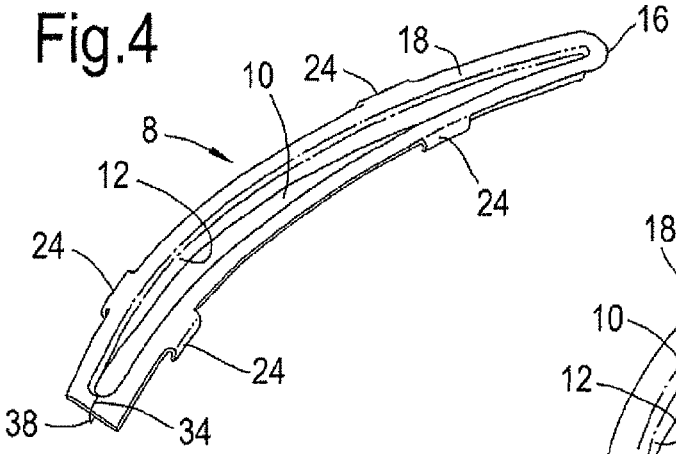
FIG. 4 is a view of the annulus filler seal.
Figure 5:
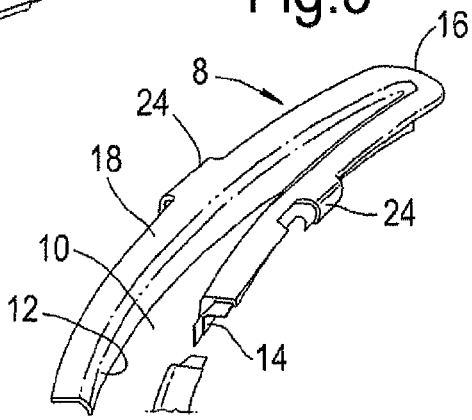
Figure 6:
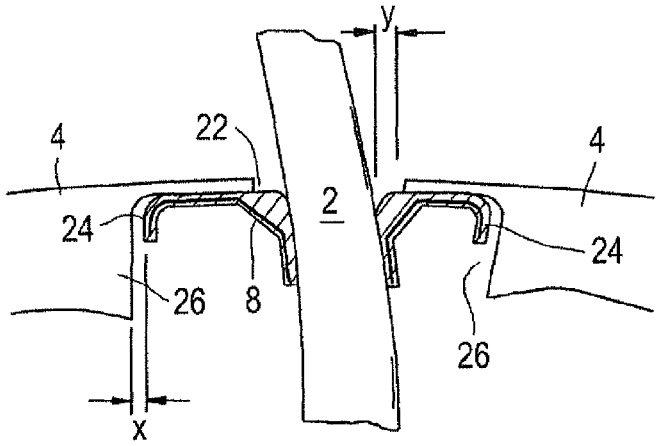
Figure 7:
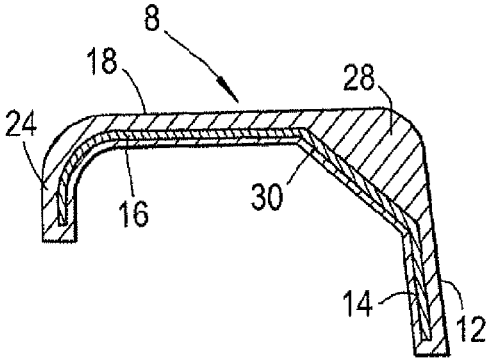
Figure 8:
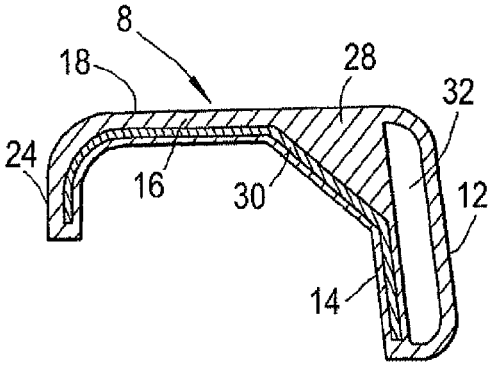
Figure 9:
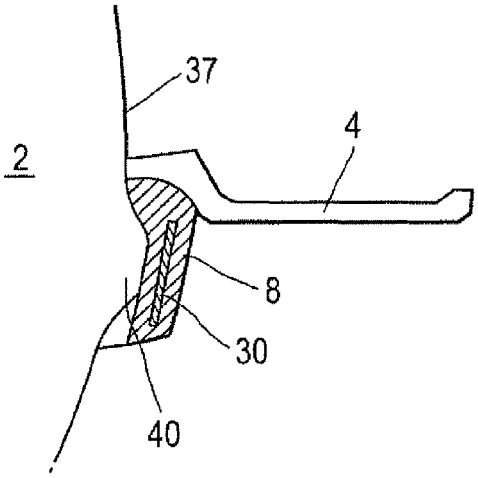

FIG. 5 corresponds to FIG. 4 but is an enlarged view of the annulus filler seal with parts cut away;

FIG. 6 corresponds to FIG. 3 but is a sectional view taken through abutment lugs;

FIG. 7 shows the annulus filler seal of FIG. 6;

FIG. 8 corresponds to FIG. 7 but shows an alternative configuration; and FIG. 9 shows part of an annulus filler seal assembly at the trailing edge of the fan blade.

Figure 1:
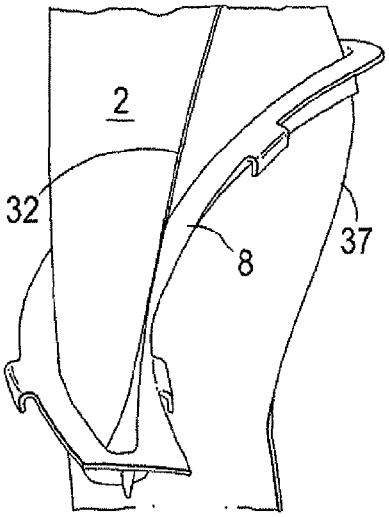
Figure 2:
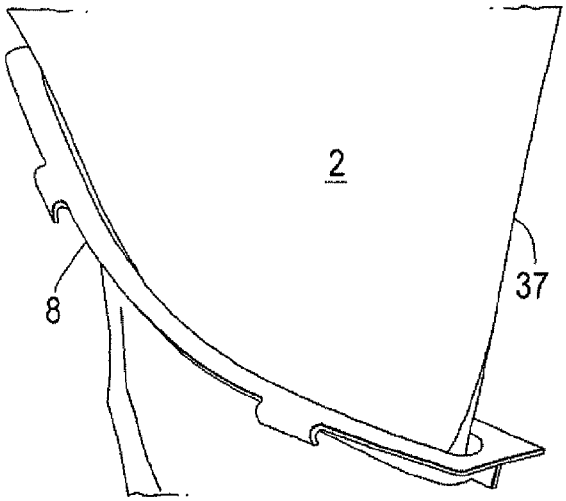

FIGS. 1 and 2 show a fan blade 2 of a fan rotor. When assembled in a fan for a gas turbine engine, the blade 2 is one of a plurality of blades in a circumferential array, secured at their roots to a disc (not shown). The spaces between adjacent blades 2 are filled by annulus fillers 4 (FIG. 3).

The radially outer surfaces 6 of the annulus fillers 4 define the inner annulus of the gasflow path through the fan during operation of the engine in which the fan is installed. There are gaps 22 between the edges of the annulus fillers 4 and the blades 2.

An annulus filler sealing element 8 is carried by the blade 2. The sealing element 8 is in the form of a closed loop, and defines an opening 10 which conforms to the profile of the blade 2 at the intended operating position of the sealing element 8 along the blade 2. The opening 10 is bounded by a blade sealing surface 12 of the sealing element 8 which contacts the blade 2 substantially around its entire periphery. As will be appreciated from FIG. 3, the sealing element 8 has a generally L-shaped cross-section and comprises a sleeve 14 which lies against the blade 2, and a lateral flange 16 which is generally perpendicular to the sleeve 14.

The flange 16 is situated at the radially outer end of the sleeve 14, and its radially outer face 18 contacts the annulus filler 4 on each side of the blade 2, and so constitutes an annulus filler sealing surface.

The blade sealing surface 12 of the sealing element 8 has a low friction finish resulting from a specific surface treatment of the material of the sealing element 8, or from the application of a coating of a suitable self-lubricating material. Consequently, although the sealing element 8 makes contact with the blade 2 around its periphery, the sealing element 8 is able to slide along the blade 2 in the direction indicated by arrows A. As a result, during rotation of the fan, the centrifugal loading imposed on the sealing element 8 causes it to be flung outwardly along the blade 2 so that the annulus filler sealing surface 18 is forced into sealing contact with the undersides of the annulus fillers 4 on both sides of the blade 2. Consequently, the gap 22 provided between the annulus fillers 4 and the blade 2 are sealed to prevent air from leaking from the gas flow path through the fan past the annulus fillers 4 in the radially inwards direction.

A low friction finish can also be provided on the annulus filler sealing surface 18.

During operation, the blades 8 undergo tangential, radial and axial movements caused by gas, thermal and centrifugal loadings, and these movements serve to vary the gaps 22 between the blade 2 and the annulus fillers 4. Because the annulus filler surface 18 can move across the undersides of the annulus fillers 4, and because the seal 8 is constantly biased by centrifugal loading in the direction of the arrows A, sealing contact between the sealing element 8 and both the blade 2 and the annulus fillers 4 is maintained.

In the event of large excursions from the nominal positions of the blade 2 and the annulus fillers 4, it is sometimes possible for the gaps 22 to close completely, and for the annulus fillers 4 to come into contact with the blade 2. This is undesirable, and, as shown in FIGS. 4 and 5 the sealing element 8 may be provided with abutment lugs 24 which project laterally beyond the remainder of the periphery of the lateral flange 16 and are turned downwardly, as shown also in FIG. 6. As indicated in FIG. 6, these lugs 24 may have a nominal position which is spaced by a distance x from a feature of the adjacent annulus filler, such as a radially inwardly extending surface 26. The surface 26 may, for example, be a surface of an attachment hook or stiffening web.

The nominal clearance x is selected so as to be smaller than the nominal clearance y between the annulus filler 4 and the blade 2 at the gap 22. Consequently, relative movement between the blade 2 and the annulus fillers 4 will be arrested by contact between the respective one of the lugs 24 and the abutment surface 26 before the blade 2 comes into contact with either of the annulus fillers 4.

As shown in FIGS. 5, 7 and 8, the sealing element 8 comprises a body 28 of a suitably compliant material, such as an elastomeric material, in which a stiffening element 30 is incorporated. The stiffening element 30 serves to maintain the overall shape of the sealing element 8, while the body 28 provides sufficient compliance to achieve an effective seal against the blade 2 and the annulus fillers 4. By way of example, the body 28 could be made from silicone rubber or polyurethane rubber, and the stiffening element 30 could be made from a sheet metal strip or a reinforced fibre composite, for example a composite material including carbon or glass fibre reinforcements. The stiffening element 30 may be incorporated in the body 28 in a co-moulding process, or by injection moulding the body 28 around the stiffening element 30.

As shown in FIG. 8, means may be incorporated in the sealing element 8 to increase the compliance of the blade sealing surface 12. For example, the body 28 may include a cavity extending along the sleeve 14 adjacent the blade sealing surface 12. The cavity may be air-filled, or it may be filled with a material having a greater compliance than the bulk material of the body 28. For example, a lower density elastomeric material, such as a foamed material, could be provided in the cavity 32.

The sealing element 8 may be segmented to enable it to be fitted around the blade 2. As shown in FIG. 4, the sealing element 8 may have a single split 34, for example at its end corresponding to the leading edge 36 of the blade 2. The split 34 enables the sealing element 8 to be opened against its own resilience, so that it can be installed from the trailing edge of the blade 2. Once in place, the split 34 can be closed, for example by a closure means acting on closure tabs 38 provided on the sealing element 8, one on each side of the split 34. The sealing element 8 may be moulded in a slightly open configuration at the split 34 to assist installation of the sealing element on the blade 2. The sealing element 8 is then held closed around the blade 2 by the closure means securing the tabs 38.

Alternatively, the sealing element could be split at both ends so that it is in two halves, which can be joined together by suitable closure means. Both ends could be secured together once the sealing element 8 is fitted around the blade 2. In other embodiments, one end could be connected to form a sub-assembly, with the other end being connected only after installation.

When the fan is not turning, the sealing elements 8 on the fan blades 2 will be influenced by gravity. The sealing elements on blades extending upwardly from the axis of the fan will tend to drop away from the annulus fillers 4. In many cases, the profile of the blade will be such that the sealing element 8 will fall by only a small distance before it is arrested by the difference in profile between the blade 2 and the opening 10. Nevertheless, for some blade profiles it may be desirable to incorporate specific measures to prevent the sealing element 8 from falling too far along the blade 2. For example, as shown in FIG. 9, the blade may have a protuberance 40 at its trailing edge 37. The protuberance 40 prevents the sealing element 8 from falling under gravity when the fan is not rotating, at least at the trailing edge of the blade. The stiffening element 30 acts in these circumstances as a hinge, allowing the sealing element to pivot about the protuberance 40 to ensure that, in normal operation when the fan is rotating, the sealing element 8 can swing about the protuberance 40 into full contact with the annulus fillers 4 over the full extent of the blade 2.

It will be appreciated that the sealing elements described above provide efficient sealing of the gap 22 without requiring bonding of the sealing element 8 to either the annulus fillers 4 or the blade 2. Consequently, the sealing element 8 can be fitted to the blade 2 as an independent component, which reduces manufacturing costs at lead time. Furthermore, in-service replacement of the sealing element 8 is quicker and easier than removal and replacement of a bonded sealing element, and can be carried out without requiring full refurbishment of the annulus fillers 4.

Furthermore, the sealing element 8 described above leaves a cavity at the gap 22 of substantially reduced size compared with that of known sealing arrangements, such as that disclosed in US 2007/0280830.

The invention claimed is:

1. A bladed rotor assembly for rotating about an axis, the bladed rotor assembly comprising:

a sealing element providing a seal between a blade of the rotor and an adjacent annulus filler, the sealing element comprising:

an opening receiving the blade, the opening being defined by a sleeve extending around the blade and providing a blade sealing surface which conforms to the profile of the blade;

an annulus filler sealing surface for sealing engagement with the annulus filler, the annulus filler sealing surface being provided on a radially outer face of the sealing element with respect to the rotational axis of the rotor; and an abutment element for engagement with an abutment surface of the annulus filler to limit relative displacement of the annulus filler in a direction towards the blade, the abutment element being provided on an outer face of the sealing element with respect to the opening and including a radially inwardly directed lug at the periphery of a lateral flange which projects outwardly with respect to the opening at the radially outer end of the sleeve.

2. A bladed rotor as claimed in claim 1, in which the sealing element is disposed radially inwards of the annulus filler.

3. A bladed rotor as claimed in claim 1, in which the sealing element is radially slidable on the blade.

4. A bladed rotor as claimed in claim 1, in which a lateral flange projects outwardly with respect to the opening at the radially outer end of the sleeve.

5. A bladed rotor as claimed in claim 1, in which the sealing element comprises a body of an elastomeric material on which the blade sealing surface and the annulus filler sealing surface are provided.

6. A bladed rotor as claimed in claim 5, in which a stiffening element is bonded to the body of elastomeric material.

7. A bladed rotor as claimed in claim 1, in which the sealing element and the blade have cooperating features to restrict displacement of the sealing element away from the annulus filler.

8. A bladed rotor as claimed in claim 1, in which the sealing element is circumferentially split.

9. A bladed rotor as claimed in claim 8, in which the sealing element is split at the leading edge and/or the trailing edge of the blade.

10. A bladed rotor assembly for rotating about an axis, the bladed rotor assembly comprising:

a sealing element providing a seal between a blade of the rotor and an adjacent annulus filler, the sealing element comprising:

an opening receiving the blade, the opening being defined by a sleeve extending around the blade and providing a blade sealing surface which conforms to the profile of the blade;

an annulus filler sealing surface for sealing engagement with the annulus filler, the annulus filler sealing surface being provided on a radially outer face of the sealing element with respect to the rotational axis of the rotor; and a body of an elastomeric material on which the blade sealing surface and the annulus filler sealing surface are provided, the body comprising an internal compliant region adjacent the blade sealing surface.

11. A bladed rotor as claimed in claim 10, in which the internal compliant region comprises an air-filled cavity.

12. A bladed rotor as claimed in claim 10, in which the internal compliant region comprises a material having greater compliance than that of the elastomeric material of the body.

13. A bladed rotor as claimed in claim 10, in which the sealing element is disposed radially inwards of the annulus filler.

14. A bladed rotor as claimed in claim 10, in which the sealing element is radially slidable on the blade.

15. A bladed rotor as claimed claim 10, in which an abutment element is provided on an outer face of the sealing element with respect to the opening, for engagement with an abutment surface of the annulus filler to limit relative displacement of the annulus filler in a direction towards the blade.

16. A bladed rotor as claimed in claim 10, in which a lateral flange projects outwardly with respect to the opening at the radially outer end of the sleeve.

17. A bladed rotor as claimed in claim 10, in which the sealing element comprises a body of an elastomeric material on which the blade sealing surface and the annulus filler sealing surface are provided.

18. A bladed rotor as claimed in claim 17, in which a stiffening element is bonded to the body of elastomeric material.

19. A bladed rotor as claimed in claim 10, in which the sealing element and the blade have cooperating features to restrict displacement of the sealing element away from the annulus filler.

20. A bladed rotor as claimed in claim 10, in which the sealing element is circumferentially split.

21. A bladed rotor as claimed in claim 20, in which the sealing element is split at the leading edge and/or the trailing edge of the blade.

* * * * *